US008002898B2

(12) United States Patent
Schepers et al.

(10) Patent No.: US 8,002,898 B2
(45) Date of Patent: Aug. 23, 2011

(54) MATERIAL DELIVERY SYSTEMS AND METHODS

(75) Inventors: Frederik J. Schepers, Baarn (NL); Evert P. Baars, Wijk bij Duurstede (NL); Andrew J. Cocking, Ben Lomond, CA (US); Wai Yin Cedric Chan, Santa Cruz, CA (US); James W. Livingston, Manton, CA (US)

(73) Assignee: Diversey, Inc., Sturtevant, WI (US)

( * ) Notice: Subject to any disclaimer, the term of this patent is extended or adjusted under 35 U.S.C. 154(b) by 493 days.

(21) Appl. No.: 11/960,350

(22) Filed: Dec. 19, 2007

(65) Prior Publication Data

US 2009/0159098 A1 Jun. 25, 2009

(51) Int. Cl.
*B08B 7/00* (2006.01)

(52) U.S. Cl. ..... 134/18; 134/25.1

(58) Field of Classification Search ..... 134/18, 134/25.1

See application file for complete search history.

(56) References Cited

U.S. PATENT DOCUMENTS

| | | | | |
|---|---|---|---|---|
| 4,848,381 | A * | 7/1989 | Livingston et al. | 134/57 R |
| 5,448,115 | A | 9/1995 | Howland et al. | |
| 5,500,050 | A | 3/1996 | Chan et al. | |
| 5,556,478 | A | 9/1996 | Brady et al. | |
| 5,681,400 | A | 10/1997 | Brady et al. | |
| 5,782,109 | A | 7/1998 | Spriggs et al. | |
| 6,792,637 | B2 | 9/2004 | Reichold et al. | |
| 6,819,977 | B2 | 11/2004 | Howes, Jr. et al. | |
| 6,892,143 | B2 | 5/2005 | Howes, Jr. et al. | |
| 6,895,307 | B2 | 5/2005 | Gardner, Jr. | |
| 2006/0162466 | A1 * | 7/2006 | Wargo et al. | 73/861.63 |

FOREIGN PATENT DOCUMENTS

| | | |
|---|---|---|
| JP | 02647744 | 8/1997 |
| JP | 2006-528051 | 12/2006 |
| KR | 10-1997-0062159 | 9/1997 |
| KR | 10-1998-0017289 | 6/1998 |
| KR | 10-2003-0004715 | 1/2003 |

OTHER PUBLICATIONS

The International Search Report prepared by the Korean Intellectual Property Office, Jul. 2009.

* cited by examiner

*Primary Examiner* — Michael Kornakov
*Assistant Examiner* — Nicole Blan
(74) *Attorney, Agent, or Firm* — Gregory S. Bollis

(57) ABSTRACT

A method of determining one or more operational parameters of a washing system having a wash tank to which water and material are added. In one embodiment, the method includes monitoring a concentration of material, which is decreased at least partially due to water being added to the wash tank. The method also includes maintaining the concentration of material by dispensing material into the wash tank during a material dispensing operation. Additionally, the method includes generating a parameter indicative of a rate at which the material is dispensed during the material dispensing operation. The method also includes determining a presence of a water flow abnormality based at least partially on the generated parameter.

7 Claims, 5 Drawing Sheets

MATERIAL DELIVERY SYSTEMS AND METHODS

FIELD

The invention generally relates to material dispensing systems. More specifically, the invention relates to methods and systems of operating and controlling material dispensing systems.

BACKGROUND

As washing machines (e.g., dish washers, create washers, bottle washers, instrument washers, clothes washers, etc.) have become more sophisticated, systems have been implemented to automatically feed such machines with products (e.g., detergents, sanitizers, rinse aids, chemicals, and the like) which may be produced in liquid, condensed, compressed, granulated, and/or powdered form. Such materials may be automatically delivered to a variety of types of washing machines, and their concentration monitored using a variety of methods.

SUMMARY

In one embodiment, a method of determining one or more operational parameters of a washing system having a wash tank to which water and material are added includes monitoring a concentration of material, which is decreased at least partially due to water being added to the wash tank. The method also includes maintaining the concentration of material by dispensing material into the wash tank, which is dispensed during a material dispensing operation. Additionally, the method includes generating a parameter indicative of a rate at which the material is dispensed during the material dispensing operation. The method also includes determining a presence of a water flow abnormality based at least partially on the generated parameter.

In another embodiment, the invention provides a system for determining one or more operational parameters of a washing system having a tank to which water and material are added. The system includes a sensor, a dispensing device, and a controller. The sensor is positioned in the tank and generates a first signal indicative of a material concentration. The dispensing device dispenses a metered quantity of material into the tank, and generates a second signal indicative of the quantity of material that is dispensed. The material is dispensed to maintain the material concentration above a predetermined material concentration threshold. The controller receives the first signal from the sensor and the second signal from the dispensing device, determines a parameter indicative of a quantity of material that is added to the tank and a frequency at which material is added to the tank, and correlates the parameter to an amount of water added to the tank.

In another embodiment, a method of delivering two or more materials to a washing system having a tank to which water is added includes determining a first material concentration threshold indicative of a desired material concentration of a first material in the tank; determining a second material concentration threshold indicative of a desired material concentration of a second material in the tank; and monitoring a material concentration in the tank. During a first mode in which only the first material is delivered to the tank, the method includes determining a first dose rate of the first material necessary for the monitored material concentration to reach the first material concentration threshold, and determining a first water flow based on the first dose rate. During a second mode in which the first material and the second material are delivered to the tank, the method also includes determining a second dose rate of the second material necessary for the monitored material concentration to reach the second material concentration threshold, and determining a second water flow based on the second dose rate. A presence of a water flow abnormality is determined based at least partially on the determined first water flow or second water flow.

Other embodiments of the invention will become apparent by consideration of the detailed description and accompanying drawings.

DETAILED DESCRIPTION

Figure 1:
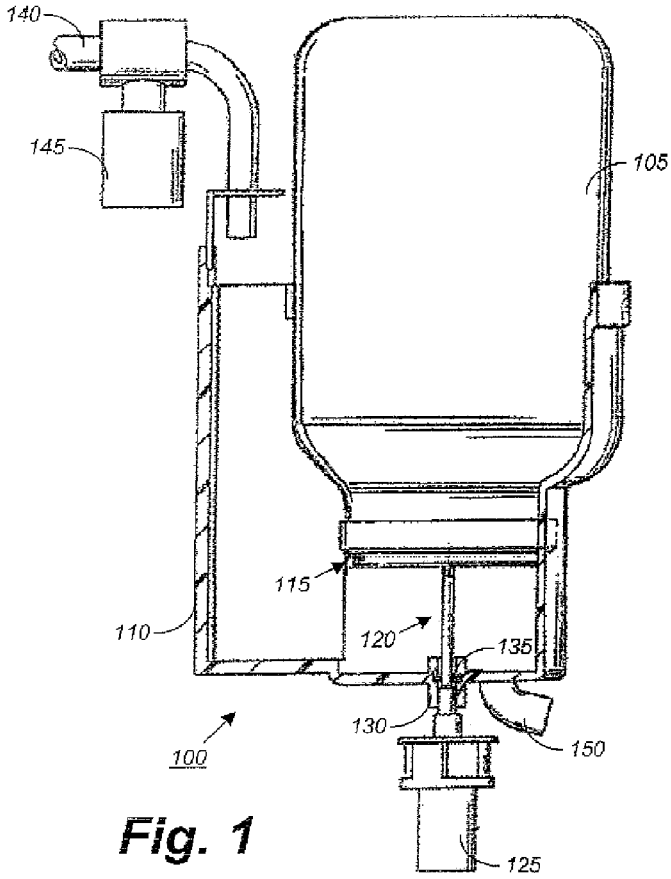
FIG. 1 illustrates an exemplary dispensing system, according to an embodiment of the invention.

Before any embodiments of the invention are explained in detail, it is to be understood that the invention is not limited in its application to the details of constriction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Embodiments of the invention relate to systems and methods of determining a quantity of material that is provided to a wash tank of a washing system while the concentration of the material is maintained above a predetermined concentration set point. This can be accomplished, for example, using a material dispensing system and one or more sensors. Embodiments of the invention also relate to determining a correlation between a quantity of material being added to a wash tank during a predetermined duration and a quantity of water entering and/or exiting the wash tank of the washing system. In an embodiment, a dose (or number of doses) of material is added to the wash tank to maintain the material concentration of the wash tank above a predetermined material concentration set point (as monitored by sensor). A controller can monitor the quantity of material dosed, and compare the quantity of material added to the wash tank to a predetermined expected or "normal" quantity of material that is added to the wash tank during typical use. The comparison can then be correlated to an amount of water that is entering and/or exiting the washing system, which can be used to identify water flow abnormalities. For example, if the quantity of material added to the wash tank is greater than the expected quantity (over a predetermined duration), excessive water use can be identified. Alternatively, if the quantity of material added to the wash tank is less than the expected quantity (over a predetermined duration), deficient water use can be identified. Identifying such water flow abnormalities provides valuable information to a user, for example, via an alarm or message. Additionally, the water flow abnormalities can be identified without the use of flow meters or other sensing devices, which may reduce the overall complexity of the washing system.

In other embodiments, the dose rate of the material provided to the wash tank is determined and correlated to an amount of water that is entering and/or exiting the washing system, which can be used to identify water flow abnormalities.

FIG. 1 illustrates an exemplary dispensing system 100. In some embodiments, the dispensing system 100 is configured to dispense or deliver a granulated or powder material (e.g., such as a detergent, a sanitizer, a rinse aid, a chemical, etc.). In other embodiments, the dispensing system 100 may be configured to dispense material in an alternative form (e.g., a liquid material). Additionally, in some embodiments, the dispensing system 100 is adapted for use in or with a larger washing system (e.g., the washing system shown in FIG. 3). For example, the dispensing system 100 can be used to deliver a granular or powder material to a dish washing machine that has several tanks or stages. However, in other embodiments, the dispensing system 100 can be used in a washing system having a single washing compartment.

In the embodiment shown in FIG. 1, the dispensing system 100 generally includes a granulated material or powder container 105 that is supported in a dispenser assembly or receptacle 110. The container 105 is closed on one end by a metering and dispensing closure 115, which, as described in greater detail with respect to FIG. 2, can deliver or dose a predetermined amount of material from the container 105 into the receptacle 110. For example, in one embodiment, the dispensing closure 115 is rotated by a drive shaft 120 to deliver the material. The drive shaft 120 is driven by a drive member 125, and is journalled in a collar 130 with a seal 135.

The dispensing system 100 also includes a water intake conduit 140 that is controlled by a solenoid valve 145. The water intake conduit 140 and solenoid valve 145 are utilized to introduce water into the receptacle 110. For example, in some embodiments, when the solenoid valve 145 is energized, water from the water intake conduit 140 is allowed to enter the receptacle 110. Alternatively, when the solenoid valve 145 is de-energized, water is prevented from entering the receptacle 110. In other embodiments, a valve mechanism other than the solenoid valve 145 may be used.

A water solution outlet conduit 150 is also in communication with the receptacle 110. For example, the outlet conduit 150 allows water to exit the receptacle 110. In some embodiments, as described in greater detail below, water is mixed with dispensed material prior to exiting the receptacle 110 through the outlet conduit 150. In the embodiment shown in FIG. 1, liquid or solution is allowed to exit the receptacle 110 through the outlet conduit 150 relatively unobstructed. In other embodiments, the outlet conduit 150 may include a solenoid valve or other valve, similar to the solenoid valve 145.

In some embodiments, as described in greater detail below, the dispensing system 100 can also include electronic components such as a controller and one or more conductivity sensors. For example, in one embodiment, one or more conductivity sensors are positioned in the receptacle 110 to monitor the conductivity of the receptacle 110 (and the liquid disposed therein).

Figure 2:
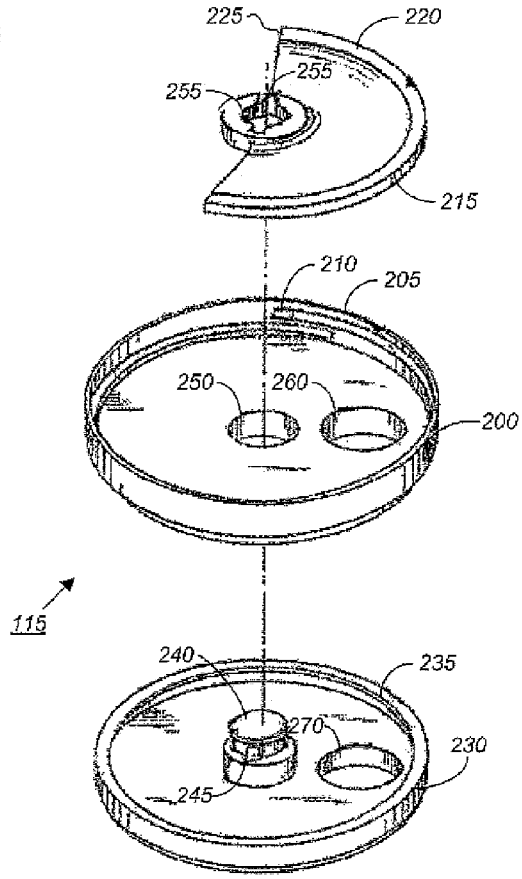
FIG. 2 illustrates an exemplary dispensing closure, according to an embodiment of the invention.

As shown in FIG. 2, the metering and dispensing closure 115 is generally composed of three basic components. For example, the closure 115 generally includes a cap member 200 with an upstanding wall 205 and internal threads 210 for engaging complementary threads on the container 105. The second component is a rotatable disk 215 with a raised peripheral wall 220, as well as a cutaway portion 225. Rotatable disk 215 is configured to be seated inside the cap member 200. The third component is a rotatable disk 230 with a raised peripheral wall 235 and a stub shaft 240 with projections 245. These projections 245 fit through an opening 250 in the cap member 200 such that the projections 245 engage slots 255 in the rotatable disk 215. Rotatable disks 215 and 230 are rotated by the shaft 120 (see FIG. 1) connected to the stub shaft 240.

Referring to FIGS. 1 and 2, in operation, the container 105 holding the material is supported in the receptacle 110. Water is introduced into the receptacle 110 through the water intake conduit 140. The metering and dispensing closure 115 is attached to the container 105. When the disks 215 and 230 of the closure 115 are properly aligned, the material from the container 105 is free to enter into a measuring opening or chamber 260 as it is uncovered by disk 215 and cutaway 225 (see FIG. 2). However, the material from the container 105 cannot pass into the receptacle 110, as the passage is blocked by rotatable disk 230. Activation of the drive member 125 and rotation of the drive shaft 120 causes the upper rotatable disk 215 and the lower rotatable disk 230 to move to a second position in which no more material can enter the opening 260, which has become a measuring chamber. Continued rotation of the disks 215 and 230 allows for the opening 260 to be positioned over opening 270, which allows the dose of material from the measuring chamber to flow into the receptacle 110 and be mixed with water from the intake conduit 140. The mixed material then exits the receptacle 110 through the water solution outlet conduit 150. In some embodiments, multiple doses are delivered during a single delivery cycle.

The embodiments shown in FIGS. 1-2 are generally used to dispense a granulated or powder material. However, as previously described, in some embodiments, material may be delivered to a washing system by a variety of methods. For example, in an alternative embodiment, a peristaltic pump may be used to deliver a liquid material to a washing system. Other delivery material delivery systems and methods may also be employed (e.g., a gear pump, a diaphragm pump, etc.), as should be appreciated by one of ordinary skill in the art.

Figure 3:
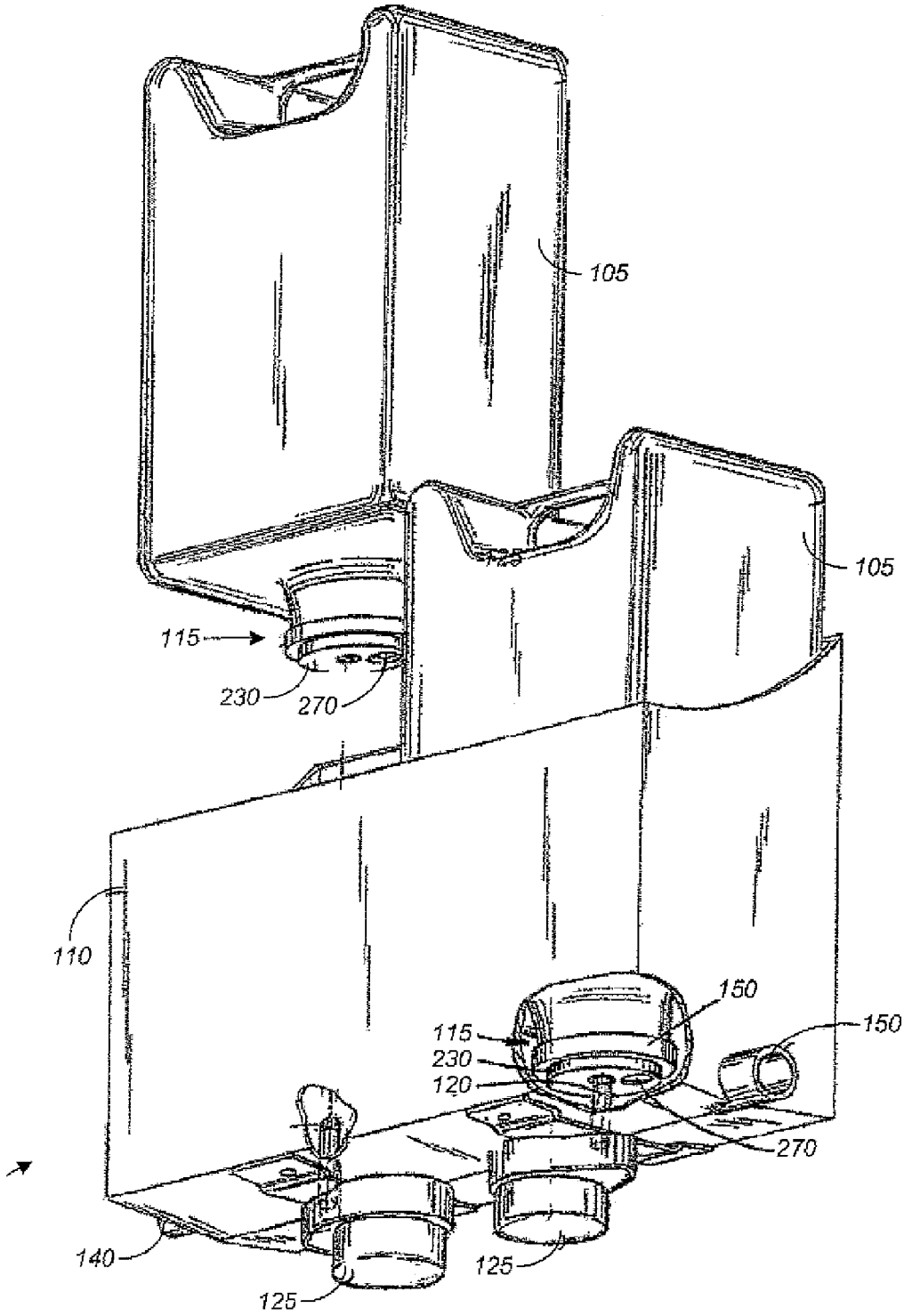
FIG. 3 illustrates an exemplary dispensing system, according to another embodiment of the invention.

Referring to FIG. 3, an additional embodiment of a dispensing system is shown. In the embodiment shown in FIG. 3, components similar to, or the same as, the components shown in FIGS. 1 and 2 are labeled with like numerals. For example, FIG. 3 illustrates a dispensing system 300 that includes two containers 105. In some embodiments, the separate containers 105 are utilized to introduce separate powder or granulated materials (e.g., a detergent and an alkali booster) to the water supply.

Figure 4:
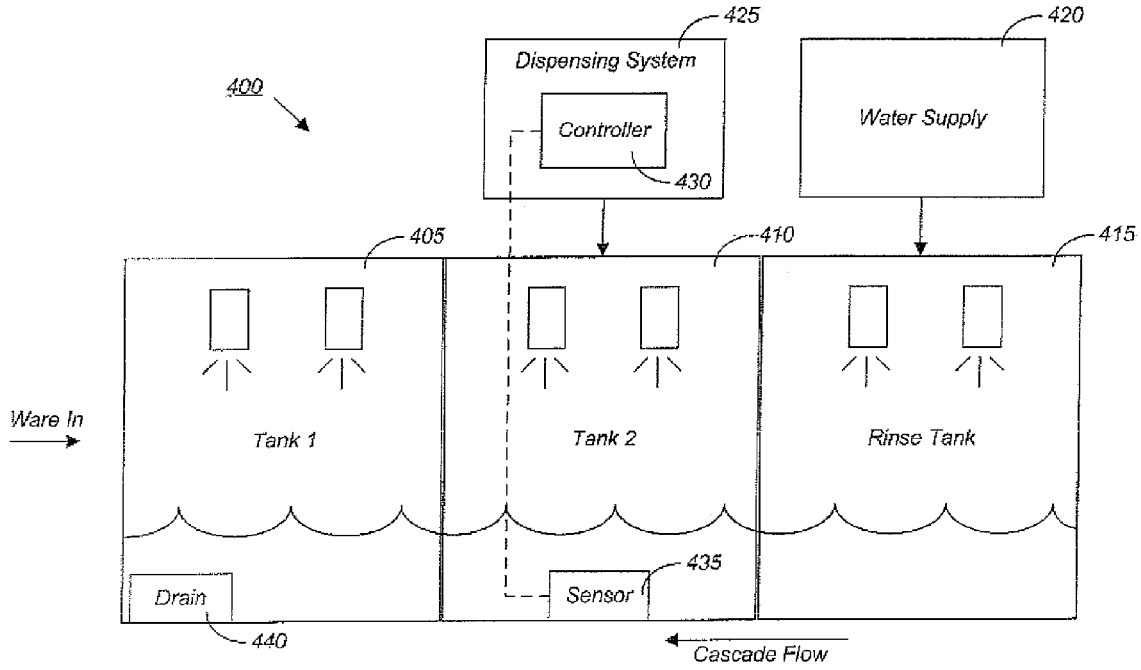
FIG. 4 illustrates an exemplary washing system, according to an embodiment of the invention.

FIG. 4 illustrates an exemplary washing system 400. In some embodiments, the washing system 400 is configured to clean and/or sanitize dishes and utensils ("ware"). In other embodiments, the washing system 400 may be configured to clean other items (e.g., a medical instrument washing system, a bottle washing system, etc.). The washing system 400 generally includes a first wash tank 405, a second wash tank 410, and a rinse tank 415, although a variety of other tanks can also be implemented (e.g., a pre-rinse tank, additional wash tanks, and the like). Alternatively, the washing system 400 may include fewer tanks than those shown in FIG. 4 (e.g., a single wash tank). A water supply 420 provides fresh water to one or more of the tanks 405-415 of the washing system, while a dispensing system 425 having a controller 430 and a sensor 435 provides one or more materials (e.g., detergent, sanitizer, alkali, etc.) to one or more of the tanks 405-415. In some embodiments, the dispensing system 425 is configured similarly to the dispensing system 100 shown in FIGS. 1-3, having a dispensing closure or other device that dispenses or "doses" a predetermined (e.g., a measured) amount of material.

In the embodiment shown in FIG. 4, the first wash tank 405, the second wash tank 410, and the rinse tank 415 are approximately the same size. However, in other embodiments, the tanks 405-415 may be different sizes relative to each other (e.g., having a smaller rinse tank 415 than the first and second wash tanks 405 and 410). As described in greater detail below, ware generally enters the washing system 400 through the first wash tank 405, is cleaned and/or sanitized while traveling through the first wash tank 405 and the second wash tank 410, and is rinsed while traveling through the rinse tank 415. The ware then exits the washing system 400.

In some embodiments, the water supply 420 provides fresh water to the rinse tank 415 during a rinse cycle of the washing system 400. For example, after ware has been washed in the first wash tank 405 and the second wash tank 410, the ware is rinsed with incoming fresh water from the water supply 420. As such, the water supply 420 may include an associated valve (e.g., a solenoid valve) to control the supply of water to the rinse tank 415. In some embodiments, the water supply 420 may also provide fresh water to other tanks, or other components of the washing system 400 (e.g., the dispensing system 425), and thus, may include additional valves or components to control the flow of water from the water supply 420.

As described above, the dispensing system 425 may be configured similarly to the dispensing system 100 shown in FIG. 1, in that the dispensing system 425 can include a dispensing closure which provides a predetermined amount of material to the wash tanks 405 and 410. For example, for each actuation of the dispensing closure, one gram of material can be provided to the second wash tank 410. In other embodiments, an alternative amount (e.g., 0.5 grams, 1.5 grams, 3 grams, etc.) can be delivered with each actuation of the dispensing closure. Additionally, an alternative type of fixed quantity (e.g., volume or weight) material metering and material dispensing apparatus may be employed.

Generally, the controller 430 is a suitable electronic device, such as, for example, a programmable logic controller ("PLC"), a computer, a microcontroller, a microprocessor, and/or other industrial/personal computing device. As such, the controller 430 may include both hardware and software components, and is meant to broadly encompass the combination of such components. The controller 430 is responsible for executing a variety of tasks and/or processes. For example, in some embodiments, the controller 430 determines when to actuate the water supply 420, as well as when to dispense material into the wash tanks 405 and 410. Additionally, the controller 430 can, in some embodiments, determine fluctuations in water flow (see, for example, the process shown with respect to FIG. 5), and/or dispense material using a variety of dispensing schemes (see, for example, the process shown with respect to FIG. 6).

To carry out the tasks and/or processes, the controller 430 communicates with a variety of components of the washing system 400. These communications may be wired or wireless. For example, to control the water supply 420, the controller 425 transmits a signal to the one or more valves associated with the water supply 420 to turn the valves on or off. Additionally, to determine when to dispense material into the wash tanks 405 and 410, the controller 430 receives and processes a signal from the sensor 435 positioned in one of the wash tanks 405 and 410 (as described in greater detail below). In other embodiments, the controller 430 may also be in communication with other components of the washing system 400 (e.g., other sensors, valves, and the like) and/or with external components interfaced with the controller 430. For example, in some embodiments, the controller 430 may be in communication with a server or other storage device, allowing the controller 430 to upload data (e.g., operational parameters) of the washing system.

In the embodiment shown in FIG. 4, the sensor 435 is positioned in the second wash tank 410, and transmits a signal to the controller 430 indicative of a material concentration (e.g., the material concentration of the water in the second wash tank 410). In other embodiments, the sensor 435 may be positioned in the first wash tank 405. The sensor 435 can be configured to measure a variety of different parameters of the second wash tank 410, which can be used to determine the concentration of material in the second wash tank 410. For example, in some embodiments, the sensor 435 is a conductivity sensor that measures the conductivity of the water in the second wash tank 410. That conductivity data is then used to determine the concentration of material in the second wash tank 410. In other embodiments, the sensor 435 may be an alternative type of sensor whose signal can be used to determine a concentration of material in the second wash tank 435. For example, the sensor 435 may be an infra-red ("IR") sensor, an ultraviolet ("UV") absorber, an oxidation-reduction potential ("ORP") sensor, or other type of sensor.

In some embodiments, the sensor 435 also includes a temperature sensing capability. For example, in addition to transmitting a signal indicative of the conductivity of the second wash tank 410, the sensor 435 can transmit a signal that is indicative of the temperature of the second wash tank 410. The temperature data can then be used to provide a more accurate representation of the concentration of the material in the second wash tank 410. Additionally or alternatively, the sensor 435 (or an additional sensor) can be used to measure the relative hardness of the water being added to the second wash tank 410.

In some embodiments, the material concentration of the first wash tank 405 is estimated or inferred from the material concentration of the second wash tank 410. For example, due to liquid (e.g., the water/material solution) cascading from the second wash tank 410 to the first wash tank (described below), the material concentration of the first wash tank 405 may be substantially the same as the concentration of the second wash tank 410. The controller 430 may also utilize a predetermined correction factor to determine the material concentration of the first wash tank 405 relative to the material concentration of the second wash tank 410. Alternatively, in other embodiments, a pair of sensors may be employed to independently monitor the material concentrations of the first and second wash tanks 405 and 410.

In some embodiments, the material being added to the wash tanks 405 and 410 is a detergent. In other embodiments, however, the dispensing system 425 may be adapted to dispense more than one type of material (e.g., a detergent, an alkali boost, a sanitizer, a rinse aid, etc.). In such embodiments, several sensors 435 may be required to measure material concentrations for each material being added.

During use, ware enters the washing system 400 through the first wash tank 405 and exits the washing system through the rinse tank 415. As such, ware is initially cleaned and/or sanitized while positioned in the first wash tank 405. For example, heavy soil is removed from the ware and mixes with the liquid of the first wash tank 405. The ware then moves from the first wash tank 405 to the second wash tank 410. The second wash tank 410 also removes soil (e.g., soil that is not removed from the ware while the ware is positioned in the first wash tank 405), which mixes with the liquid of the second wash tank 410. Next, the ware moves from the second wash tank 410 to the rinse tank 415, where the ware is rinsed with fresh water. In some embodiments, the ware is moved through the tanks 405-415 automatically. For example, a conveyor (or similar device) moves the ware through the tanks 405-415. In other embodiments, the ware may be manually moved through the tanks 405-415 by a user. Additionally, as described above, in other embodiments, the washing system may have more or fewer tanks than those shown (e.g., a single wash/rinse tank, additional wash tanks, a pre-rinse tank, etc.).

In the embodiment shown in FIG. 4, fresh water is generally introduced to the washing system 400 by the water supply 420 while ware is being rinsed in the rinse tank 415 (e.g., during a rinse cycle). For example, in some embodiments, during normal operation water is delivered to the rinse tank 415 by the water supply 420 at a rate of approximately seven liters per minute during a rinse cycle, although the incoming rate may vary with the configuration of the washing system 400. Incoming fresh water fills the rinse tank 415 to a predetermined level. After the water fills the rinse tank 415, water spills over, or cascades from, the rinse tank 415 into the second wash tank 410. Similarly, after the second wash tank 410 is filled to a predetermined level, water cascades from the second wash tank 410 into the first wash tank 405. After the first wash tank 405 is filled to a predetermined level, the drain 440 allows water to exit the washing system 400. In some embodiments, the drain 440 may be configured such that water automatically flows into the drain 440 upon the level of water in the first wash tank 405 exceeding a predetermined amount (e.g., the drain 440 includes a fixed opening at the relative top of the first wash tank 405). In other embodiments, to avoid backflow or overflow of the tanks 405-415, the water supply 420 and the drain 440 may be linked such that the water is not allowed to enter the washing system 400 unless a relatively equal amount exits the washing system 400 during operation. In some embodiments, during an initial or "fresh" fill operation (e.g., the tanks 405-415 are initially empty and are filled with water prior to use), water may be introduced to several of the tanks 405-415 concurrently.

As described above, material is delivered to the washing system 400 by the dispensing system 425. In the embodiment shown in FIG. 4, the dispensing system 425 delivers one or more materials to the second wash tank 410. The resulting water/material solution cascades from the second wash tank 410 into the first wash tank 405. Accordingly, the material concentration (e.g., the concentration of material in the water) of the first wash tank 405 is approximately equal to that of the first wash tank 410. In other embodiments, however, one or more materials may also be delivered directly to the first tank 405 (e.g., delivered by the dispensing system 425 or another system). Accordingly, the first wash tank 405 and the second wash tank 410 may be maintained at different material concentrations and/or include different materials.

The material concentrations of the first wash tank 405 and the second wash tank 410 are reduced by incoming fresh water (e.g., fresh water that cascades from the rinse tank 415), as well as by soil from the ware being washed. As such, as described in greater detail below, the rate at which the material concentration falls is variable. For example, if relatively heavily soiled ware is being washed, the material concentration may be reduced from the desired level relatively quickly. Additionally, if the washing system 400 is being continuously operated and rinse cycles are occurring frequently, a relatively large amount of fresh water may be introduced to the washing system 400, thereby reducing the material concentration level from the desired concentration level relatively quickly. As the material concentration deviates from a desired level, material is dosed to maintain the desired level (described below). This material dosing may occur in regular and relatively predictable intervals.

The embodiment described with respect to FIG. 4 includes a washing system having multiple tanks that are filled with water. Material is added to the water to create a water/material solution. However, as should be appreciated by one of ordinary skill in the art, components similar to those shown and described with respect to FIG. 4 may be applied in an alternative system in which material is added to a liquid that is not water. For example, a facility that produces beverages may implement a material dispensing system which provides a material to a beverage solution. Alternatively, a gasoline refining facility may implement a material dispensing system that provides an additive to the gasoline. Other alternatives are also possible. In such embodiments, controlling and sensing devices (such as the controller 430 and the sensor 435) can be utilized.

Figure 5:
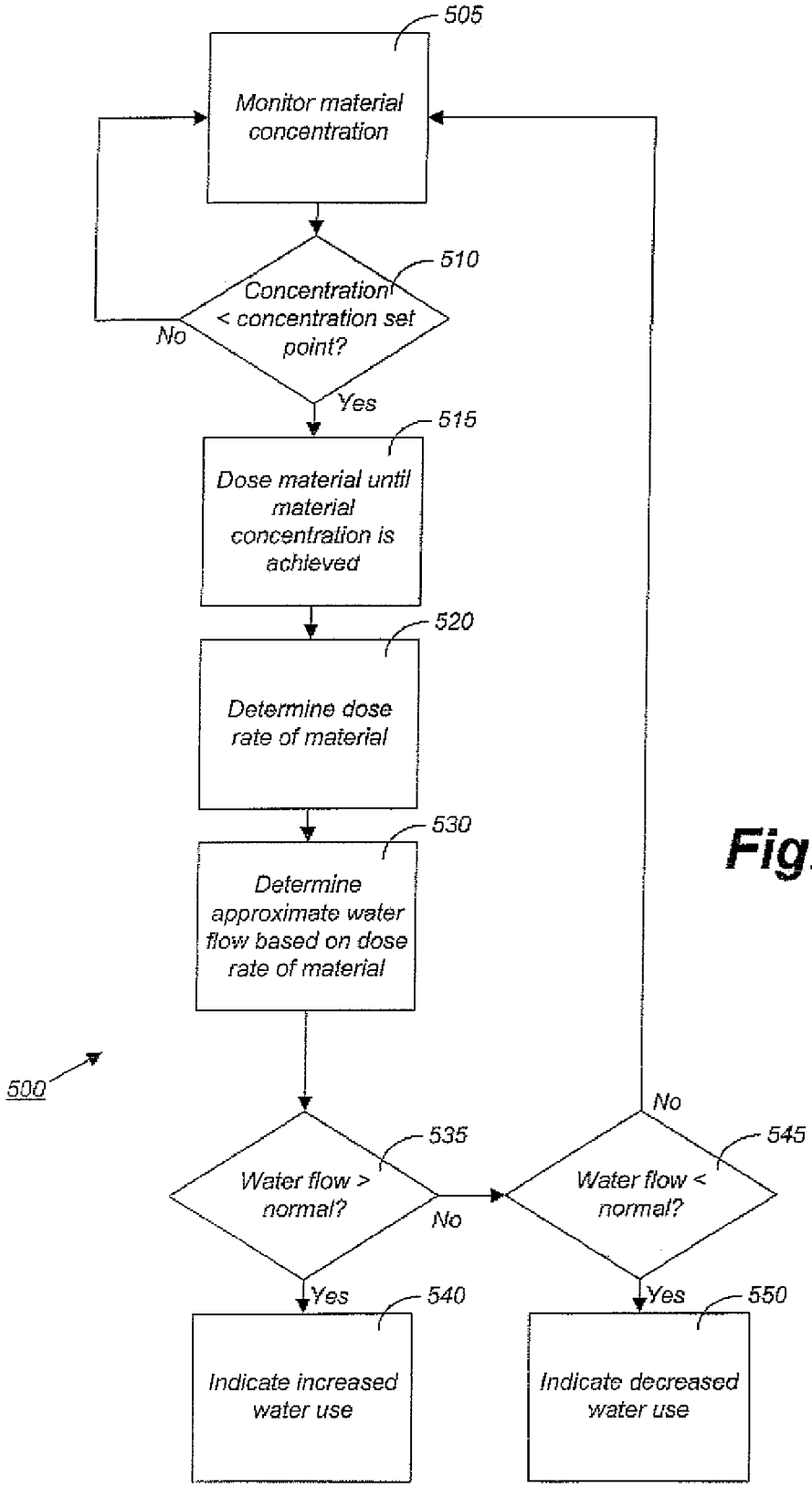
FIG. 5 illustrates an exemplary process by which water flow associated with a washing system can be determined, according to an embodiment of the invention.
Figure 6:
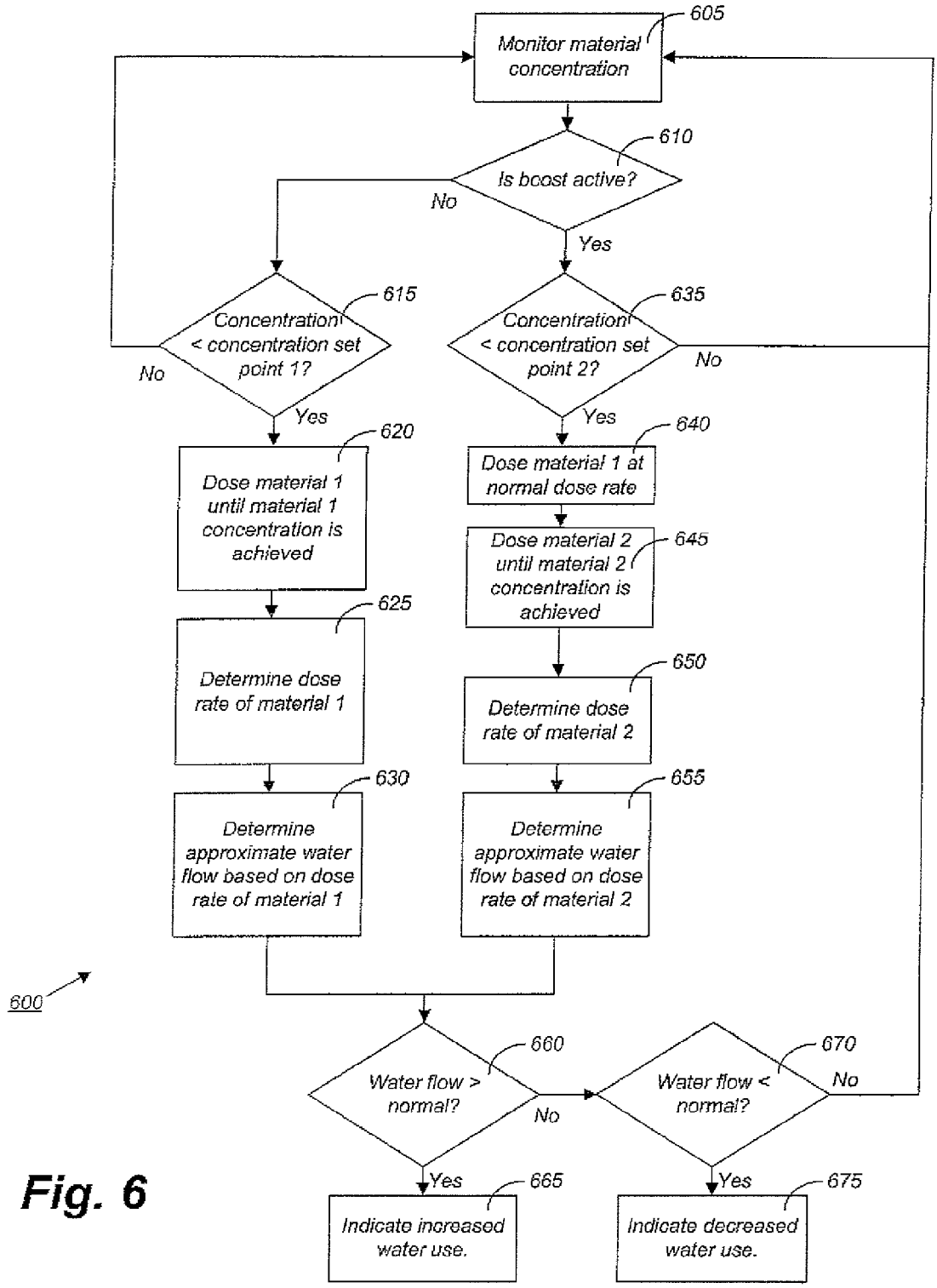
FIG. 6 illustrates an exemplary process by which water flow associated with a washing system can be determined, according to an embodiment of the invention.

FIGS. 5 and 6 illustrate exemplary processes that can be used to determine, store, and/or utilize operational parameters of a washing system. As such, the embodiments of FIGS. 5 and 6 are described herein as being implemented with the washing system 400 shown in FIG. 4. However, as should be apparent to one of ordinary skill in the art, the processes may be implemented with an alternative washing system.

FIG. 5 illustrates an exemplary process 500 for evaluating water flow and/or use associated with a washing system. For example, as described in greater detail below, the process 500 can be used to identify excessive water flow through the washing system 400, as well as limited or deficient water flow through the washing system 400. The process 500 begins by establishing a communication link between the sensor 435 and the dispensing system 425, and monitoring the material concentration of the second wash tank 410 (step 505). As described above, this communication link may be wired or wireless. In some embodiments, the sensor 435 may be positioned in the first wash tank 405, and, accordingly, the material concentration of the first wash tank 405 is measured.

The monitored material concentration then is compared to a material concentration threshold or set point (step 510). For example, prior to operating the washing system 400, a user (e.g., an installation technician) may determine a desired material concentration that effectively cleans the ware in the machine 400, without using an excessive amount of material. This desired material concentration may be determined prior to installing the washing system 400, for example, through testing. In some embodiments, the material concentration is maintained at 1.0 grams per liter (g/L).

If the monitored material concentration falls below the material concentration set point, a material dosing operation is carried out by the dispensing system 425, and material is dosed until the desired material concentration is achieved (step 515). Material dosing may be delayed until the material concentration has fallen by a predetermined amount. For example, in some embodiments, the material concentration is allowed to descend from 1.0 g/L to 0.85 g/L (i.e., a material concentration reduction of 0.15 g/L) before material is dosed to elevate the material concentration back to 1.0 g/L. In other embodiments, a different allowed concentration reduction may be implemented (e.g., 0.1 g/L, 0.25 g/L, etc.). Additionally, in other embodiments, as should be apparent to one of ordinary skill in the art, an alternative material concentration measurement can be used.

Upon achieving the desired material concentration, the dose rate during the material dosing operation (e.g., the rate at which the material was delivered by the dispensing system 425 to achieve the desired material concentration) is determined (step 520). The dose rate can be determined, for example, based on measured and/or stored parameters indicative of quantity and/or time. For example, in embodiments which implement a rotating enclosure that dispenses a metered quantity (e.g., volume or weight) of material every revolution, the number of revolutions can be monitored and determined over a predetermined duration (e.g., a half hour, an hour, three hours, etc.). The dose rate can be determined from such parameters and then used to determine an approximate quantity of fresh water that is entering and/or exiting the washing system 400 through the rinse tank 415 (step 530). In some embodiments, the water flow can be determined by monitoring whether the material concentration is maintained or changes as expected over time (e.g., whether the conductivity is maintained consistent with basic numerical assumptions or more rigorous calculations).

Increased or decreased water usage can be identified based on the determined water flow. For example, if the water flow is greater than an expected water flow (step 535), increased or excessive water usage can be identified, and an indication is provided to a user of the washing system 400 (step 540). Excessive water usage may be caused by, for example, the drain 440 remaining open during a washing cycle or a water supply valve that has seized up in an open position. Alternatively, if the water flow is less than an expected water flow (step 545), decreased or deficient water usage can be identified, and an indication is provided to a user of the washing system 400 (step 550). Deficient water usage may be caused by, for example, blocked rinsing nozzles associated with the rinse tank 415 or a water supply valve that has seized up in a closed position. If excessive or deficient water usage is not identified, the process 500 returns to step 505 and the process 500 is repeated.

In some embodiments, the indication may be a message that is sent to a user of the washing system 400 (e.g., a short messaging service ("SMS") message, a pager message, an email message, etc.). In other embodiments, the indication may be included in a report, for example, generated by a data logging application included in the controller 430. In other embodiments, the indication may be an audible (e.g., a beep, a buzz, or the like) and/or visual (e.g., a flashing light) indication that is provided to the user via a control panel included in the dispensing system 425. Other alternative manners of providing an indication to the user of the washing system 400 are also possible, as should be appreciated by one of ordinary skill in the art.

In another embodiment (not shown), the quantity of material that was dosed during the material dosing operation (e.g., the quantity of material that was delivered by the dispensing system 425 to achieve the desired material concentration) is determined and compared to a projected or expected quantity over a predetermined duration. For example, in one embodiment, during normal operation of the washing system 400, approximately 17.5 grams of material is required to be dosed every 2.4 minutes to maintain the material concentration between 0.85 g/L and 1.0 g/L (e.g., assuming a tank volume of 100 L and an incoming fresh water rate of 7 L/min). This dosing quantity can then be extrapolated for the predetermined duration. As should be recognized by one of ordinary skill in the art, dose quantities and rates may vary widely based on washing system configuration and usage. The comparison between the determined and expected quantity of material can be used to determine approximate water flow into, or out of, the washing system 400.

In another embodiment, the quantity of material that is dosed during the dosing operation and the duration between dosing operations are gathered, and such data is used to determine the rate at which the material concentration is being reduced. In some embodiments, the determined material concentration reduction rate can then be used to determine an approximate amount of fresh water that is entering and/or exiting the washing system 400 through the rinse tank 415. For example, increased or excessive water usage can be identified if the rate at which the material concentration is reduced is greater than an expected rate. Alternatively, a deficient water supply can be identified if the rate at which the material concentration is reduced is less than an expected rate.

FIG. 6 illustrates an exemplary process 600 for evaluating water flow and/or use associated with a washing system. For example, as described in greater detail below, the process 600 can be employed for contexts involving delivery of two materials.

The process 600 begins by initializing operation of the washing system 400 and monitoring the material concentration of the first or second wash tanks 405 and 410 of the washing system 400 (step 605). A determination is made whether "boost" is active (step 610). For example, in some embodiments, a second, or "boost" material (e.g., an alkali material) is added to the washing system 400 (in addition to the first material) during periods of increased or constant washing system operation to ensure that enough material is present to sufficiently clean the ware being washed and/or sanitized in the washing system. A boost material may also be delivered if ware having relatively heavy soil is being washed and/or sanitized by the washing system 400. In some embodiments, boost material is automatically added to the washing system 400 during predetermined times or events. For example, if the washing system is installed in a restaurant or other eatery, a user may configure the washing system 400 to automatically add the boost material during breakfast, lunch, or dinner times in anticipation of increased washing system operation. In other embodiments, a user may manually initiate delivery of the boost material.

If boost is not active, the material concentration is compared to a first material concentration threshold or set point (step 615). If the material concentration is not less than the first set point, the process returns to step 605 to monitor material concentration. If, however, the material concentration is less than the first set point, the first material is dosed until the first set point is achieved (step 620). The dose rate of the first material is then determined (step 625). The approximate water flow is determined based on the dose rate of the first material (step 630).

If boost is active (step 610), the material concentration is compared to a second concentration threshold or set point (step 635). If the material concentration is not less than the second set point, the process returns to step 605 to monitor material concentration. If, however, the material concentration is less than the second set point, the first material is dosed at a normal dose rate (step 640), and the second material is dosed until the second set point is achieved (step 645). The dose rate of the second material is then determined (step 650). The approximate water flow is determined based on the dose rate of the second material (step 655).

The process 600 continues in a similar manner to steps 535 to 550 of FIG. 5, wherein increased or decreased water usage can be identified based on the determined water flow. Specifically, if the water flow determined in step 630 or 655 is greater than an expected water flow (step 660), increased or excessive water usage can be identified, and an indication is provided to a user of the washing system 400 (step 665). Alternatively, if the water flow is less than an expected water flow (step 670), decreased or deficient water usage can be identified, and an indication is provided to a user of the washing system 400 (step 675). If excessive or deficient water usage is not identified, the process 600 returns to step 605 and the process 600 is repeated.

If other embodiments (not shown), operational parameters of the washing system 400 can be monitored and/or stored for future use. For example, operational parameters such as dose quantities and durations between doses of a first material can be monitored for a predetermined amount of time during normal washing system operations (e.g., washing system operations in which the material concentration of the wash tanks 405 and 410 is being continually monitored). Those stored operational parameters can then be implemented during future operations, thereby eliminating the need to continually monitor the material concentration of the wash tanks 405 and 410 to control the delivery of the first material. This may be useful to allow a first material to be dosed based on stored operational parameters, while a second material is dosed based on a real-time evaluation of material concentration.

In some embodiments, a timer is utilized for monitoring and/or storing of operational parameters associated with the washing system 400. The duration of the timer may vary according to the location and intended use of the washing system 400. For example, in some embodiments, the washing system 400 is used to wash dishes in a restaurant that serves breakfast, lunch, and dinner. Accordingly, the duration of the timer may be long enough to capture the material dispensing variations associated with each of the meals. For example, relatively more material may be used to maintain the desired material concentration during peak meal times, and relatively less material may be used to maintain the material concentration during non-peak times. In other embodiments, the duration of the timer may be longer or shorter than an entire day (e.g., 1 hour, 4 hours, 8 hours, etc.). In this way, the timer can be optimized to the operational constraints of the setting in which the washing system 400 is installed (e.g., a restaurant, a cafeteria, a hotel, etc.). By employing a timer, the amount of data collected can be automatically implemented, without requiring a user to start and stop data collection. In other embodiments, a user may manually start and stop the collection of data.

As described above, for embodiments in which the washing system 400 is utilized as a ware washing machine, the material concentration of the wash tanks 405 and 410 may be reduced due to soil and fresh water. Accordingly, material may be added during operation of the washing system 400 to maintain the desired material concentration level. In some embodiments, the amount of material that is added is tracked by monitoring the number of doses of material that are added. Additionally, the amount of time that passes between each material dose may be monitored.

Each of the monitored parameters (e.g., number of material doses, time between each dose, temperature of the liquid in the wash tanks 405 and 410, water hardness in the tanks 405-415, amount of water added to the rinse tank 415, etc.) can be stored in a memory associated with the controller 430. For example, each time that the dispensing system 425 dispenses material to achieve the desired concentration, the number of doses of material that are dispensed is stored. Additionally, the frequency at which the dispensing system 425 dispenses material is stored.

The operational parameters can continue to be monitored and stored until the timer has elapsed. After the timer has elapsed, an indication can be provided that the operational parameters associated with the first material have been stored. This indication may be audible or visual. For example, in some embodiments, a light included in the dispensing system 425 flashes after the operational parameters have been stored and are ready for use. In some embodiments, operational parameters associated with the first material are previously stored or loaded into the controller 430.

The process 600 shown in FIG. 6 can utilize two material delivery schemes or modes (i.e., delivering a material based on stored parameters, and delivering a material based on a signal from a sensor) to deliver material to a washing system. However, as should be appreciated by one of ordinary skill in the art, materials may be delivered based on an alternative delivery scheme. For example, in some embodiments, one or more materials are delivered to the system based on a measured amount of water that flows into the rinse tank 415 from the water supply 420. As more water is added to the washing system 400, a predetermined proportionate amount of material is added to the wash tanks 405 and 410. Such a material delivery scheme may be implemented in addition to, or instead of, one of the material delivery schemes described above. Additionally, the process 600 may be expanded to deliver more than two materials. For example, in other embodiments, operational parameters may be monitored and/or stored for multiple materials, allowing multiple materials to be delivered based on those operational parameters, while another material (or materials) is dosed using a different delivery scheme.

The embodiments described with respect to FIGS. 4-6 are directed generally to washing systems. However, as described above, and as should be appreciated by one of ordinary skill in the art, a material dispensing and monitoring system can be adapted to a variety of applications. For example, commercial and residential pool applications may require chemicals and/or other materials to be maintained at certain material concentrations. In other embodiments, boiler systems, cooling towers, water treatment facilities, and the like, may require chemicals and/or other materials to be maintained at certain material concentrations.

Various features and embodiments of the invention are set forth in the following claims.

What is claimed is:

1. A method of determining one or more operational parameters of a washing system having a wash tank to which water and material are added, the method comprising:

monitoring a concentration of material, the concentration of material being decreased at least partially due to water being added to the wash tank;

maintaining the concentration of material by dispensing material into the wash tank, the material being dispensed during a material dispensing operation;

determining a material dose rate indicative of a rate at which the material is dispensed during the material dispensing operation over a predetermined duration;

determining an approximate water flow entering or exiting the washing system based at least partially on the determined material dose rate; and determining a presence of a water flow abnormality based at least partially on the determined water flow.

2. The method of claim 1, wherein the concentration of material is monitored by evaluating a signal generated by a conductivity sensor.

3. The method of claim 1, wherein the concentration of material is maintained within a predetermined operating range.

4. The method of claim 1, wherein the material dispensing operation includes dosing a predetermined quantity of material using a material dispensing system.

5. The method of claim 1, further comprising indicating the presence of a water flow abnormality to a user.

6. The method of claim 5, further comprising indicating a water flow that is above a normal water flow.

7. The method of claim 5, further comprising indicating a water flow that is below a normal water flow.

* * * * *